United States Patent [19]

Sommer

[11] Patent Number: 4,550,909

[45] Date of Patent: Nov. 5, 1985

[54] TENNIS RACKET FRAME

[76] Inventor: Reinhold Sommer, Helgolandring 68, 4300 Essen 1, Fed. Rep. of Germany

[21] Appl. No.: 277,978

[22] Filed: Jun. 25, 1981

[30] Foreign Application Priority Data

Jun. 27, 1980 [DE] Fed. Rep. of Germany ..... 3024234

[51] Int. Cl.[4] ..... A63B 49/02

[52] U.S. Cl. ..... 273/73 G; 273/73 H

[58] Field of Search ..... 273/73 R, 73 C, 73 G, 273/73 H, 80.2, 80.8, 81 R; 272/65, 70.3, 144; 5/110; 135/68, 71, 72

[56] References Cited

U.S. PATENT DOCUMENTS

| | | | |
|---|---|---|---|
| 1,202,177 | 10/1916 | Gale | 403/292 |
| 2,373,045 | 4/1945 | Osborn | 135/72 X |
| 2,556,121 | 6/1951 | Thomas | 272/70.3 X |
| 3,086,777 | 4/1963 | Lacoste | 273/73 H |
| 3,612,526 | 10/1971 | Brull | 273/73 H X |

FOREIGN PATENT DOCUMENTS

| | | | |
|---|---|---|---|
| 1049128 | 8/1953 | France | 273/81 R |
| 381673 | 10/1932 | United Kingdom | 273/73 H |

*Primary Examiner*—Richard T. Stouffer

*Attorney, Agent, or Firm*—Karl F. Ross; Herbert Dubno

[57] ABSTRACT

A tennis racket frame, having a heart piece bridging opposite sides of the frame, is provided at the opposite sides of the frame with members interfitting with the tubular heart piece and bolted to the frame members.

7 Claims, 4 Drawing Figures

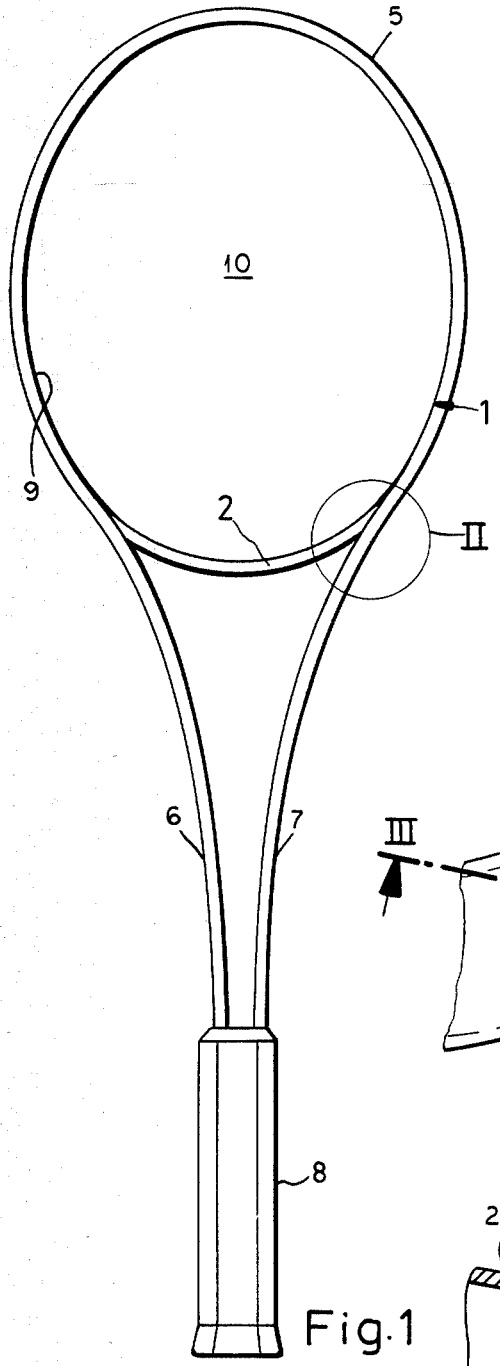
Fig.1
Fig.3
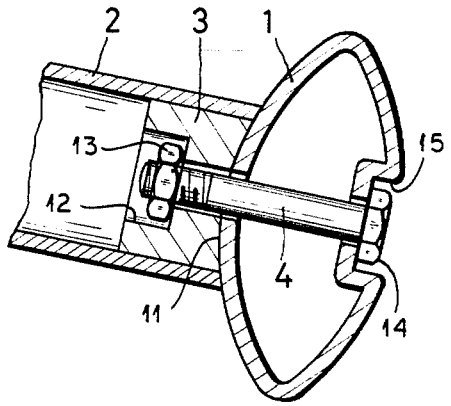
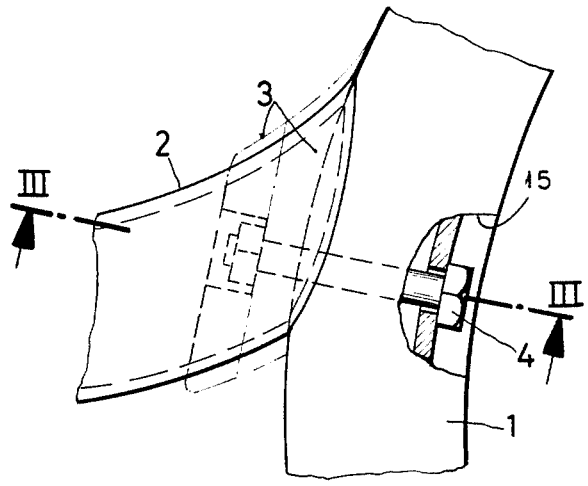
Fig. 2
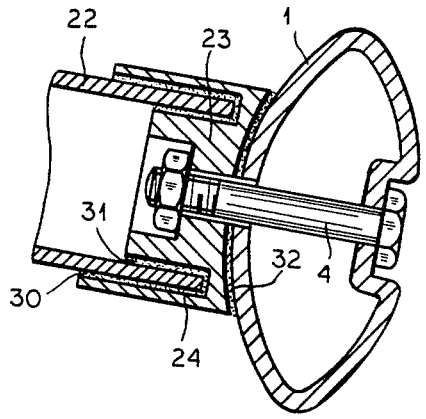
Fig.4

TENNIS RACKET FRAME

FIELD OF THE INVENTION

My present invention relates to a tennis racket frame and, more particularly, to a tennis racket frame of tubular construction wherein a heart piece bridges opposite sides of the frame, forms the bottom of the oval spanned by the strings above the handle, and stabilizes the frame structure.

BACKGROUND OF THE INVENTION

Developments in tennis racket frames have been pronounced in recent years and various frames, string supports and handle structures have been proposed utilizing frame members composed of various materials and fabricated by various methods.

In spite of the considerable efforts which have been exerted to develop the perfect tennis racket, improvements are constantly being made and, indeed, are constantly being sought.

It is important for a tennis racket frame to have high stability, light weight and freedom from the tendency to generate disconcerting sounds. Other desiderata for effective tennis racket frames include long useful life, resistance to breakage, ease of assembly, etc.

In recent years the desire for high-strength low-weight rackets has resulted in the development of tennis racket frames which are composed of metal, metal-reinforced plastic or even esoteric composites (e.g. carbon, glass or other fiber reinforced synthetic resin), tubular or hollow-profile frames.

Where the opposite sides of the frame are brought together to be incorporated into the handle, a bridge or heart piece of tubular material is spanned across the bottom of the oval to complete the enclosed area which is to be spanned by the strings.

The heart or bridge piece also increases the stability of the frame against twisting. It is generally located in the region at which the frame sides are bent from their oval-forming curvature to the handle-forming curvature.

It has been a common practice to connect this bridge piece to the opposite sides of the tubular frame by rivets. With use of the racket, however, the rivets, their heads and the regions adjacent the rivets were highly stressed and the rivet connection tends to loosen. With even the slightest loosening, the racket began to produce unpleasant sounds when the ball was struck as a result of the friction of the bridge piece and the remainder of the frame or friction in direction between the rivet and the members joined by it. It was not uncommon for the rivet to break with time.

In another approach the heart piece or bridge was welded to the frame members. This, however, resulted in stresses in the material of the frame or the bridge piece leading to breakage of the frame.

OBJECTS OF THE INVENTION

It is the principal object of the present invention to provide a tennis racket frame whereby these disadvantages of earlier frames are obviated.

Another object of this invention is to provide an improved tennis frame of high stability, long life and freedom from unpleasant noises.

It is also an object of this invention to provide a tennis racket frame which can be assembled simply and economically.

SUMMARY OF THE INVENTION

These objects and others which will become apparent hereinafter are attained in accordance with the present invention in a tennis frame which comprises a tubular frame-forming member having an oval-forming portion and opposite sides reaching toward a handle at the bottom of this portion, and a heart or bridge piece interconnecting these sides.

According to the invention, on the inner flanks of these sides at the region of the bottom of the oval-forming portion, respective inwardly projecting members are fastened and the bridge piece is formed as a hollow profile or tubular member of complementary shape which can form-fittingly engage these projecting members at the end of the bridge piece, whereby the bridge piece is fixed immovably between the shanks of the frame-forming member.

According to a preferred embodiment of the invention, the outer form of the connecting member or projection corresponds substantially to the form of the inner cross section of the bridge piece so that the ends of the bridge piece are fitted over the connecting members which are wholly received within the tubular bridge piece and closely fitted thereto.

In another embodiment of the invention, the connecting members can have hollows of a configuration corresponding to the configuration of the bridge piece so as to receive the latter. This hollow can also be in the configuration of an annular groove.

Advantageously, each connecting member is secured to the respective frame shank by a screw or bolt. Using conventional techniques, the bolt can be locked against opening.

It has been found to be advantageous, moreover, to provide an adhesive, e.g. an alpha-cyanoacrylate or epoxy resin between each connecting member and the frame. It has also been found to be advantageous to fill any gaps resulting from manufacturing tolerances between the bridge piece and the connecting member, with a settable adhesive, e.g. of the type mentioned previously.

Finally, mention should be made of the fact that it has been found to be advantageous to the purposes of force transmission to utilize, as the bridge piece, a tubular or hollow profile whose cross section is the same as that of the frame-forming member.

BRIEF DESCRIPTION OF THE DRAWING

The above and other objects, features and advantages of the present invention will become more readily apparent from the following description, reference being made to the accompanying drawing in which:

FIG. 1 is an elevational view of a tennis racket frame;

FIG. 2 is a detail view, partly broken away, of the junction II between the bridge piece and the frame-forming member, it being noted that a corresponding junction is provided in a mirror symmetry at the opposite end of the bridge piece:

FIG. 3 is a sectional view along the line III—III of FIG. 2; and

FIG. 4 is a view similar to FIG. 3 but illustrating another embodiment of the invention.

SPECIFIC DESCRIPTION

In FIGS. 1 through 3 of the drawing, I have shown a frame 1 for a tennis racket which comprises a frame-forming member 5 of tubular (hollow) profile configuration, e.g. with an oval profile as shown in FIG. 3.

The one-piece frame member 5 has a pair of shanks 6, 7 which are joined together in a handle 8 and which diverge away from each other as they approach the oval-forming portion 9. The open area 10, which is spanned by the strings (not shown), is completed by a heart or bridge piece 2 which is curved to form the bottom of the oval and is of the same profile or cross section as member 5.

According to the invention at the inner sides 11 of the shanks 6 and 7 at the bottom of the oval-forming portion, respective connecting members 5 are bolted. In the construction shown, the members 3 are plug-shaped and conform in cross section to the bridge piece 2 into which they are fitted. Each member 3 has a cavity 12 in which the head 13 of a screw can be received so as to be nonrotatable, the bolt 4 having a head 14 in a groove 15 running along the exterior of the frame, being tightenable to lock the member 3 in place. The thread of the bolt can be previously provided with a conventional adhesive designed to prevent inadvertent loosening of the bolt.

In the embodiment of FIGS. 1 through 3 the ends of the bridge piece 2 are fitted over members 3 although these members can be simply inserted into the members as shown in dot-dash lines in FIG. 2 or in greater detail in FIG. 4. The connecting surfaces of frame 1 and piece 3 as well as the juxtaposed surfaces of members 2 and 3 can be further joined by binders or adhesives.

In FIG. 4, for example, the connecting member 23 has an annular groove 24 in which the bridge member 22 is received and the adhesive layers are represented at 30 through 32.

I claim:

1. A tennis racket frame comprising a tubular frame-forming member having an oval-forming portion adapted to be spanned by racket stringing, and a pair of shanks reaching away from said oval-forming portion toward a handle, respective connecting members mounted upon inner flanks of each of said shanks at the bottom of said oval-forming portion, a curved tubular bridge piece extending along and completing the bottom of the oval formed by said portion and interfitting with said connecting members, said connecting members being projections plugged into said bridge piece and have outer configurations complementary to the inner configuration of said bridge piece, and bolt means releasably interconnecting each of said connecting members upon the respective flanks of said shanks.

2. The tennis racket frame defined in claim 1 wherein said connecting members receive said bridge piece and have inner configurations complementary to the outer configuration of said bridge piece.

3. The tennis racket frame defined in claim 1, or claim 2 wherein each of said connecting members is formed with an annular groove complementary to and receiving the respective end of said bridge piece.

4. The tennis racket frame defined in claim 1, or claim 2 wherein each of said connecting members is joined to the respective shank by a respective screw.

5. The tennis racket frame defined in claim 1, or claim 2, further comprising a layer of adhesive between each of said connecting members and the respective shank.

6. The tennis racket frame defined in claim 1, or claim 2, further comprising an adhesive between each of said connecting members and said bridge piece.

7. The tennis racket frame defined in claim 1, or claim 2 wherein said bridge piece is a tubular member having the same profile as that of said frame-forming member.

* * * * *